US008966770B2

(12) United States Patent
Lau

(10) Patent No.: US 8,966,770 B2
(45) Date of Patent: Mar. 3, 2015

(54) CUTTING APPARATUS

(71) Applicant: Ping Sun Lau, Hong Kong (HK)

(72) Inventor: Ping Sun Lau, Hong Kong (HK)

( * ) Notice: Subject to any disclaimer, the term of this patent is extended or adjusted under 35 U.S.C. 154(b) by 204 days.

(21) Appl. No.: 13/659,265

(22) Filed: Oct. 24, 2012

(65) Prior Publication Data

US 2014/0109414 A1 Apr. 24, 2014

(51) Int. Cl.
*B26B 1/04* (2006.01)

(52) U.S. Cl.
USPC ..... 30/161; 30/153

(58) Field of Classification Search
USPC ..... 30/153, 155–156, 161
See application file for complete search history.

(56) References Cited

U.S. PATENT DOCUMENTS

| | | | | |
|---|---|---|---|---|
| 4,573,268 | A * | 3/1986 | Call | 30/161 |
| 6,438,848 | B1 * | 8/2002 | McHenry et al. | 30/161 |
| 2006/0080841 | A1 * | 4/2006 | Hatcher et al. | 30/155 |

* cited by examiner

*Primary Examiner* — Kenneth E. Peterson
*Assistant Examiner* — Nhat Chieu Do
(74) *Attorney, Agent, or Firm* — Novoclaims Patent Services LLC; Mei Lin Wong

(57) ABSTRACT

A cutting apparatus includes a handle frame, a cutting blade, and a blade rotation arrangement. The cutting blade has a first blade portion and a second blade portion. The blade rotation arrangement includes a pivot, a securing frame and an actuation member. The cutting blade is arranged to rotate between a first position and a second position, wherein in the first position, the first blade portion is extended out of the receiving cavity while the second blade portion is received in the receiving cavity, wherein in the second position, the second blade portion is extended out of the receiving cavity while the first blade portion is received in the receiving cavity. The securing frame is mounted in the receiving cavity for reinforcing the cutting blade when the cutting blade move between and at the first position and the second position.

18 Claims, 4 Drawing Sheets

CUTTING APPARATUS

BACKGROUND OF THE PRESENT INVENTION

1. Field of Invention

The present invention relates to a cutting apparatus, and more particularly to a cutting apparatus comprising a blade rotation arrangement for facilitating rotation of a cutting blade in a secure and convenient manner.

2. Description of Related Arts

A conventional cutting apparatus, such as a rotating knife, an elongated handle having supporting cavity formed therein, and an elongated blade rotatably supported in the supporting cavity for rotatably extending out of the elongated handle to cut a desirable object. The elongated blade usually has two opposed end portions crafted and designed to accomplish two different cutting purposes. For example, one end portion of the elongated blade may have a regular cutting blade while the other end portion has a plurality of teeth formed thereon so as to allow a user to use it as a mini saw.

This kind of conventional rotating knife usually has an actuation device provided on the elongated handle for normally locking a position of the elongated blade. When the actuation device is actuated, the elongated blade is unlocked and a user is able to rotate the elongated blade. The purpose of this conventional rotating knife is that the user may selectively utilize two different kinds of blade through rotating the elongated blade mounted on the elongated handle. There exist a number of disadvantages in associated with this conventional rotating knife, these disadvantages will be discussed below with reference to U.S. Pat. No. 7,124,510 to Frazer.

Referring to FIG. 3 and FIG. 3A of '510 patent, the rotating knife comprises a handle having two side pieces joined together by threaded fasteners. Each side piece has a thin, flat liner, preferably metal, secured to the remainder of the handle side pieces. One of the side pieces has a recess for the locking mechanism to operate. The locking mechanism includes a lever and a lock pin pivotally carried by the front end portion of the lever (by another small axle) and protrudes through aligned holes in the liners and the blade. In other words, the locking of the blade is accomplished solely by means of the lock pin penetrating through the liners and the blade. This structure is very weak in strength, especially when the lock pin is pivotally moved to lock and unlock the blade and is itself carried by a small axle. When the rotating knife has been used for a prolonged period of time, the lock pin or the small axle may break easily and the locking mechanism will fail to operate.

Furthermore, the lever is pivotally mounted to the handle through another pivot pin. When the user wishes to unlock the blade, he or she needs to press on the lower end of the lever so as to pivotally disengage the lock pin from the blade and the liners. Again, it is rather easy for this pivotal mechanism of the lever to fail, especially when the rotating knife is used in extreme conditions, such as in outdoor environment during hiking, camping, or even in outdoor work.

In addition, one may appreciate from FIG. 3A of '510 patent that when the lever is pivotally to unlock the blade, the blade is kept unlocked until the lock pin is pivotally moved to engage with the blade again. The lever is normally biased by the spring mounted at a lower end portion thereof so as to normally exert an outward pulling force to the lower end portion of the lever. As a result, when the elasticity of that spring looseness, the lever may accidentally disengage from the blade and the blade is accidentally unlocked. This imparts potential safety issues for the knife disclosed in '510 patent.

Since the blade is kept unlocked until the lock pin is pivotally moved to engage with the blade again, the user has to manually determine if the blade is rotated to a proper orientation. If the blade is not properly orientated but the user erroneously determines that the blade is in the proper orientation, such as aligning with the handle, the cutting performance of the knife will be affected.

SUMMARY OF THE PRESENT INVENTION

An object of the present invention is to provide a cutting apparatus which comprises a blade rotation arrangement for facilitating rotation of a cutting blade in a secure and convenient manner.

Another object of the present invention is to provide a cutting apparatus which comprises a blade rotation arrangement comprising a plurality of securing frames for reinforcing a structural integrity and strength of the cutting apparatus when a cutting blade is locked for cutting and unlocked for rotation.

Another object of the present invention is to provide a cutting apparatus which comprises a blade rotation arrangement comprising an actuation member arranged to selectively lock a rotational movement of the cutting blade through linear motion of the actuation member. In other words, the actuation member does not rely on pivotal movement for locking and unlocking the cutting blade.

Another object of the present invention is to provide a cutting apparatus which comprises a blade rotation arrangement, wherein the actuation member is arranged to restore to its original locking position when the cutting blade is properly rotated to align with a handle frame of the cutting apparatus.

In order to accomplish the above objects, the present invention provides a cutting apparatus, comprising:

a cutting apparatus, comprising:

a handle frame which comprises a first elongated handle member and a second elongated handle member mounted to the first elongated handle member to form a receiving cavity between the first elongated handle member and the second elongated handle member;

a cutting blade having a first blade portion, a second blade portion, and a mid blade portion extended between the first blade portion and the second blade portion, wherein the cutting blade has a length longer than that of the handle frame; and a blade rotation arrangement, which comprises:

a pivot member extended from the handle frame to connect to the cutting blade for allowing the cutting blade to rotate about the pivot member between a first position and a second position, wherein in the first position, the cutting blade is rotated such that the first blade portion is extended out of the receiving cavity while the second blade portion is received in the receiving cavity, wherein in the second position, the cutting blade is rotated such that the second blade portion is extended out of the receiving cavity while the first blade portion is received in the receiving cavity;

a securing frame mounted in the receiving cavity of the handle frame and is positioned adjacent to the cutting blade for reinforcing the cutting blade when the cutting blade move between and at the first position and the second position; and an actuation member which is operatively mounted on the handle frame, and is arranged to selectively lock and retain the cutting blade in one of the first position and the second position.

According to the preferred embodiment of the present invention, the securing frame comprises a first securing member and a second securing member mounted in the receiving cavity at two sides of cutting blade so as to sandwich the cutting blade between the first securing member and the second securing member.

Each of the first securing member and the second securing member has a pivot hole formed thereon, wherein the pivot member is arranged to pass through the pivot holes of the first securing member and the second securing member and connect to the first elongated handle member and the second elongated handle member so that the cutting blade is also rotatably supported by the first securing member and the second securing member.

Moreover, the blade rotation arrangement further contains a locking slot provided on the mid blade portion of the cutting blade, wherein the actuation member is arranged to operatively engage with the locking slot for selectively locking and unlocking a rotational movement of the cutting blade.

The locking slot has a curved portion, and a first and a second longitudinal portions extended from two ends of the curved portion respectively along a longitudinal direction of the cutting blade.

Each of the first securing member and the second securing member further has a restraining slot longitudinally formed thereon, wherein he restraining slots are aligned with the locking slot formed on the mid blade portion of the cutting blade.

On the other hand, the actuation member comprises an actuating panel movably mounted in the receiving cavity of the handle frame, a locking latch transversely extended from a top end portion of the actuating panel, and a driving member transversely extended from lower end portion of the actuating panel to an exterior of the handle frame through the elongated actuation slot of the first elongated handle member, wherein the locking latch is extended from the actuating panel to slidably engage with the locking slot and the restraining slot of the first securing member and the second securing member, wherein when the cutting blade is in one of the first position and the second position, the actuation member is arranged to operate between a locking position and an unlocking position, wherein in the locking position, the locking latch is arranged to penetrate one of the first longitudinal portion and the second longitudinal portion of the locking slot so as to restrain the cutting blade from rotating while the locking latch also penetrates the first securing member and the second securing member, wherein in the unlocking position, the actuation member is upwardly pushed along a longitudinal direction thereof so that the locking latch is slid from the corresponding first longitudinal portion and the second longitudinal portion to a correspond end of the curved portion of the locking slot, wherein when the locking latch is slid into the curved portion, the cutting blade is capable of being rotated about the pivot member and is guided by the curved portion.

The actuation member further comprises a resilient member mounted to the first securing member and the actuating panel at a position near the driving member for normally exerting a force to the actuating panel for retaining the actuation member at the locking position wherein when the cutting blade is rotated such that the locking latch aligns with one of the second longitudinal portion of the locking slot, the locking latch is pulled by the resilient member to slide into the corresponding first longitudinal portion and the second longitudinal portion of the locking slot so as to lock the rotational movement of the cutting blade.

The blade rotation arrangement further comprises a guiding member and contains first through third guiding groove formed on the cutting blade, the first securing member and the second securing member respectively, wherein the first through third guiding groove are aligned with each other while the guiding member is arranged to penetrate the cutting blade, the first securing member and the second securing member through the first through third guiding grooves.

The guiding member and the first through third guiding groove are formed at positions spacedly apart from the locking slot and are shaped and designed corresponding to the locking slot so as to allow the guiding member to slide along the first through third guiding groove when the cutting blade is rotating between the first position and the second position.

The first elongated handle member further has an elongated actuation slot formed thereon for communicating with the receiving cavity, wherein the actuation member is partially exposed out of the receiving cavity for user's manual actuation through the actuation slot.

The cutting blade further has a through slot formed on the mid blade portion, wherein the pivot member is arranged to penetrate the through slot to act as a pivot for supporting a rotational movement of the cutting blade about the pivot member.

The above mentioned objectives, features, and advantages of the present invention will be more clearly described and shown in the following detailed description, drawings, and the claims.

DETAILED DESCRIPTION OF THE PREFERRED EMBODIMENT

Figure 1:
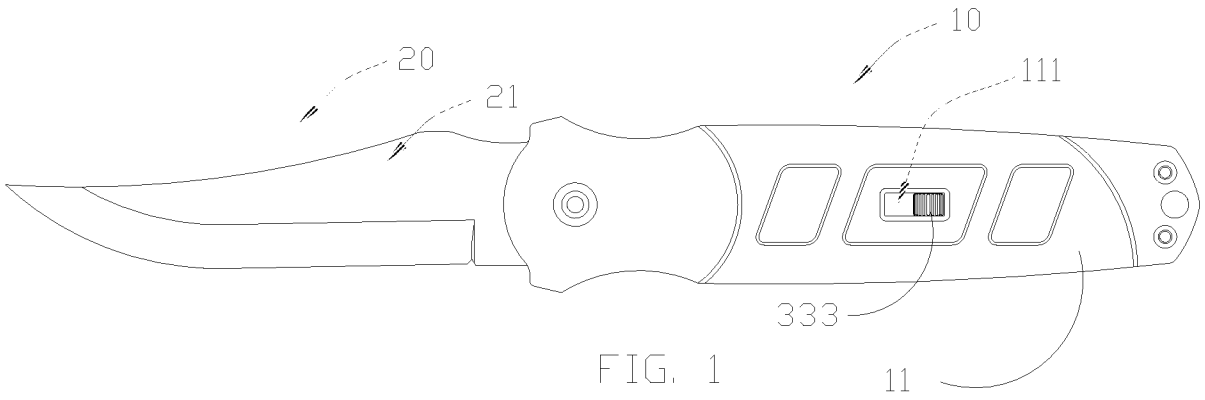
FIG. 1 is a side view of a cutting apparatus according to a preferred embodiment of the present invention.

Referring to FIG. 1 to FIG. 5 of the drawings, a cutting apparatus according to a preferred embodiment of the present invention is illustrated, in which the cutting apparatus comprises a handle frame 10, a cutting blade 20, and a blade rotation arrangement 30.

The handle frame 10 comprises a first elongated handle member 11 and a second elongated handle member 12 mounted to the first elongated handle member 11 to form a receiving cavity 13 between the first elongated handle member 11 and the second elongated handle member 12.

The cutting blade 20 has a first blade portion 21, a second blade portion 22, and a mid blade portion 23 extended between the first blade portion 21 and the second blade portion 22, wherein the cutting blade has a length longer than that of the handle frame 10.

The blade rotation arrangement 30 comprises a pivot member 31, a securing frame 32 and an actuation member 33. The pivot member 31 is extended from the handle frame 10 to connect to the cutting blade 20 for allowing the cutting blade 20 to rotate about the pivot member 31 between a first position and a second position, wherein in the first position, the cutting blade 20 is rotated such that the first blade portion 21 is extended out of the receiving cavity 13 while the second blade portion 22 is received in the receiving cavity 13, wherein in the second position, the cutting blade 20 is rotated such that the second blade portion 22 is extended out of the receiving cavity 13 while the first blade portion 21 is received in the receiving cavity 13.

The securing frame 32 is mounted in the receiving cavity 13 of the handle frame 10 and is positioned adjacent to the cutting blade 20 for reinforcing the cutting blade 20 when the cutting blade 20 moves between and at the first position and the second position.

The actuation member 33 is operatively mounted on the handle frame 10, and is arranged to selectively lock the cutting blade 20 to retain in one of the first position and the second position.

According to the preferred embodiment of the present invention, each of the first elongated handle member 11 and the second elongated handle member 12 is made of durable material, wherein the first elongated handle member 11 further has an elongated actuation slot 111 formed thereon for communicating with the receiving cavity 13, wherein the actuation member 33 is partially exposed out of the receiving cavity 13 for user's manual actuation through the actuation slot 111.

Figure 2:
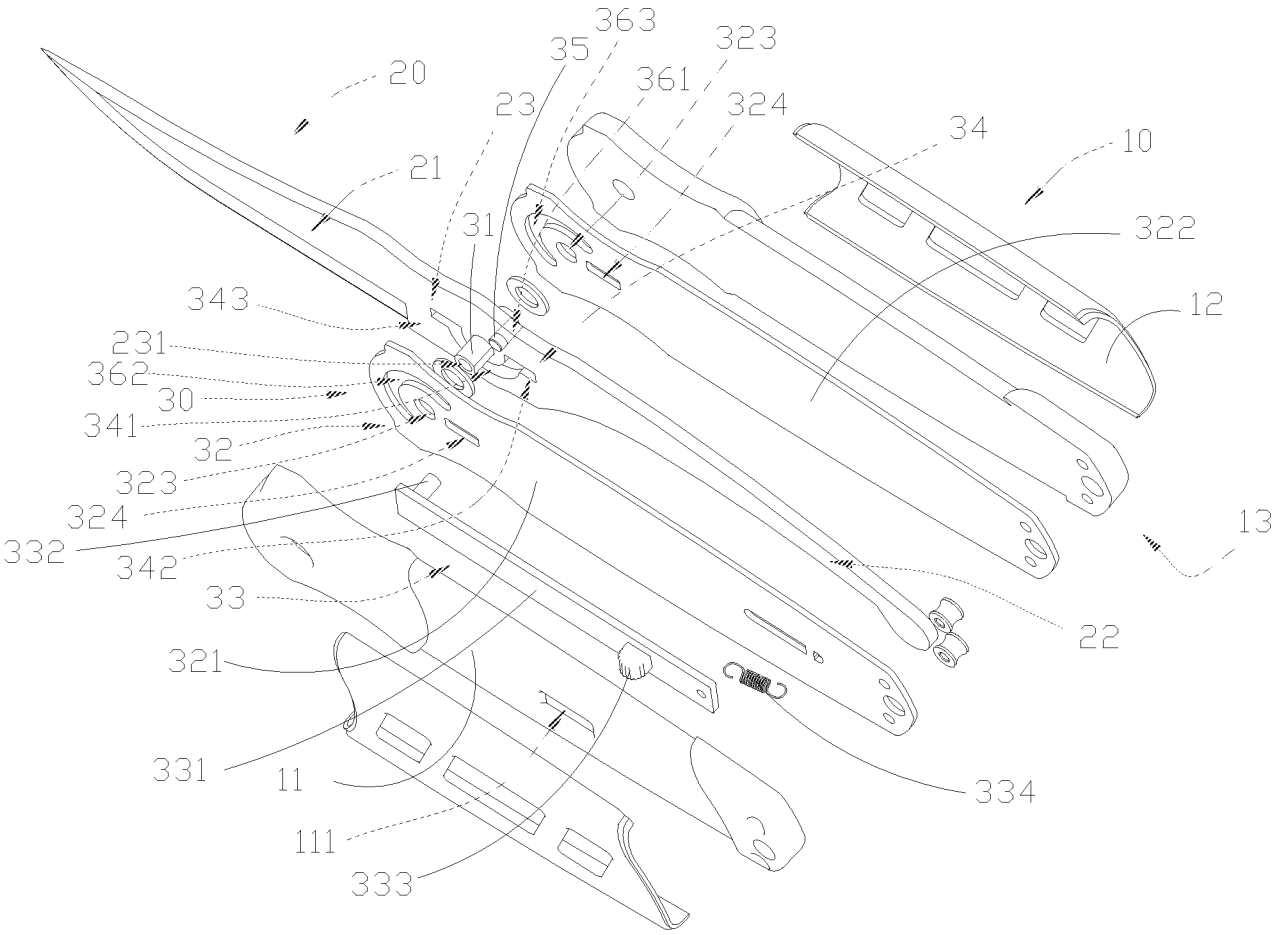
FIG. 2 is an exploded perspective view of the cutting apparatus according to the preferred embodiment of the present invention.

The cutting blade 20 is made of very strong material such as metal, wherein each of the first blade portion 21 and the second blade portion 22 are specifically designed and crafted to form different cutting tools for different cutting purposes. For example, as shown in FIG. 2 of the drawings, the first blade portion 21 is designed to perform regular cutting activities while the second blade portion 22 is designed to perform specific activities, such as opening a can.

Moreover, the mid blade portion 23 further has a through slot 231 formed thereon, wherein the pivot member 31 is arranged to penetrate the through slot 231 to act as a pivot for supporting a rotational movement of the cutting blade 20 about the pivot member 31.

The securing frame 32 comprises a first securing member 321 and a second securing member 322 mounted in the receiving cavity 13 at two sides of cutting blade 20 so as to sandwich the cutting blade 20 between the first securing member 321 and the second securing member 322. Each of the first securing member 321 and the second securing member 322 has a pivot hole 323 formed thereon, wherein the pivot member 31 is arranged to pass through the pivot holes 323 of the first securing member 321 and the second securing member 322 and connect to the first elongated handle member 11 and the second elongated handle member 12. In other words, the cutting blade 20 is also rotatably supported by the first securing member 321 and the second securing member 322 when it is locked in either the first position or the second position, or when it is rotating between the first position and the second position.

The blade rotation arrangement 30 further contains a locking slot 34 provided on the mid blade portion 23 of the cutting blade 20, wherein the actuation member 33 is arranged to operatively engage with the locking slot 34 for selectively locking and unlocking a rotational movement of the cutting blade 20. More specifically, the locking slot 34 has a curved portion 341, and a first and a second longitudinal portions 342, 343 extended from two ends of the curved portion 341 respectively along a longitudinal direction of the cutting blade 20.

As shown in FIG. 2 of the drawings, each of the first securing member 321 and the second securing member 322 further has a restraining slot 324 longitudinally formed thereon, wherein the restraining slots 324 are aligned with the locking slot 34 formed on the mid blade portion 23 of the cutting blade 20.

The actuation member 33 comprises an actuating panel 331 movably mounted in the receiving cavity 13 of the handle frame 10, a locking latch 332 transversely extended from a top end portion of the actuating panel 331, and a driving member 333 transversely extended from lower end portion of the actuating panel 331 to an exterior of the handle frame 10 through the elongated actuation slot 111 of the first elongated handle member 11.

On the other hand, the locking latch 332 is extended from the actuating panel 331 to slidably engage with the locking slot 34 and the restraining slot 324 of the first securing member 321 and the second securing member 322. Thus, the restraining slots 324 and the locking slot 34 are aligned with each other so that the locking latch 332 is capable of penetrating the restraining slots 324 and the locking slot 34.

Figure 3:
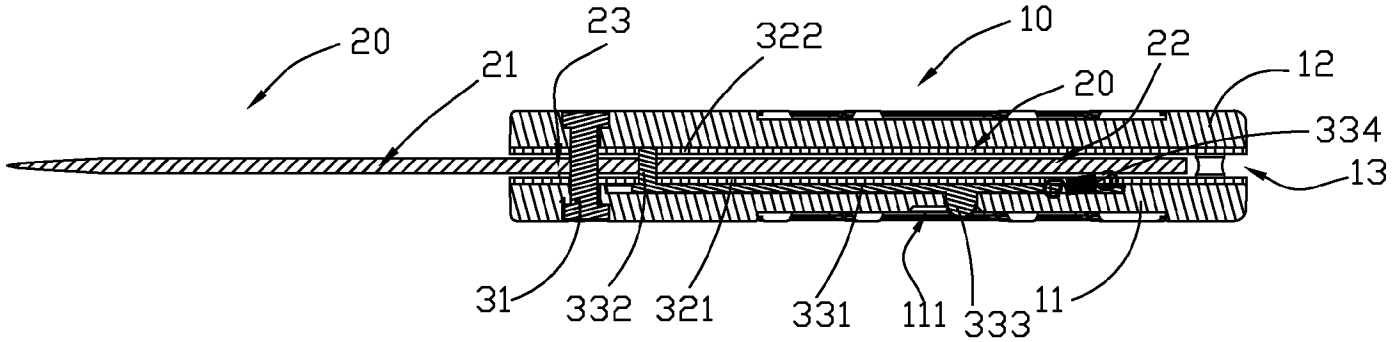
FIG. 3 is a side view of the cutting apparatus according to the preferred embodiment of the present invention, illustrating that the actuation member is in locking position.
Figure 4:
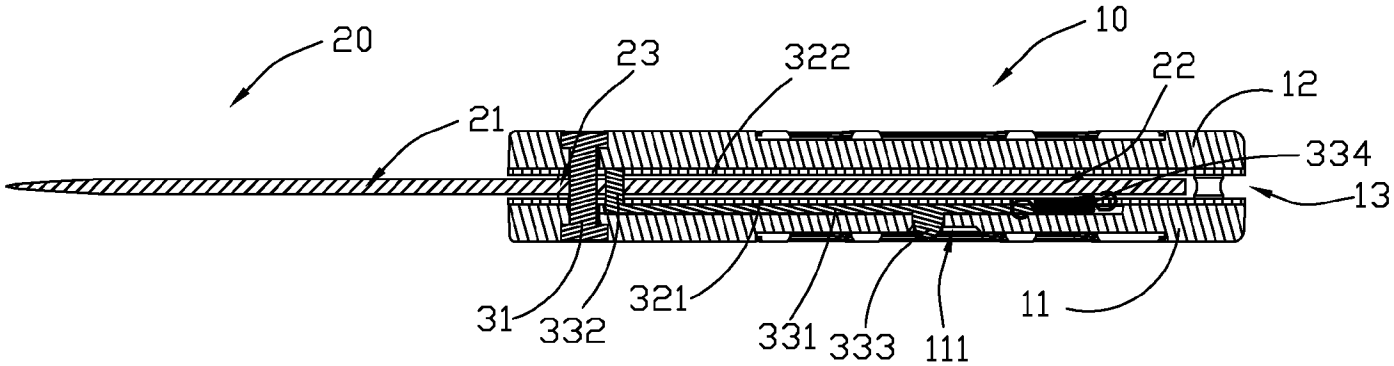
FIG. 4 is a side view of the cutting apparatus according to the preferred embodiment of the present invention, illustrating that the actuation member is in unlocking position.
Figure 5:
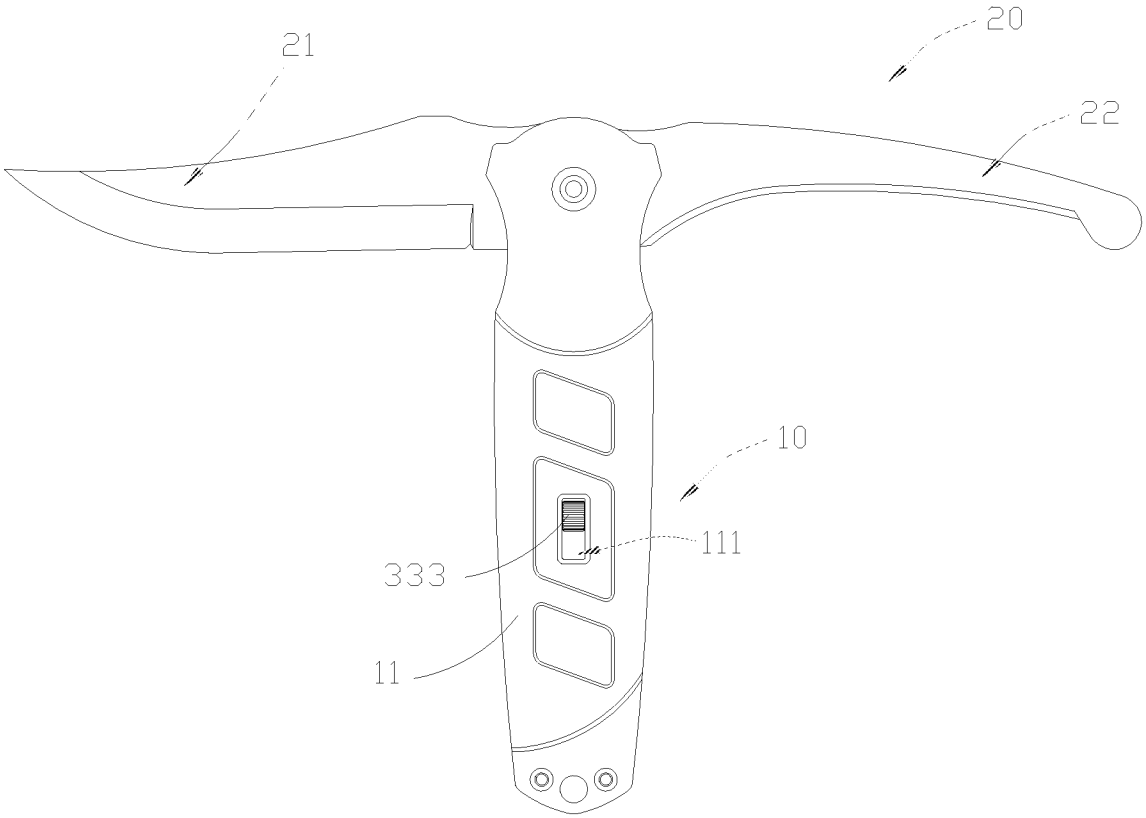
FIG. 5 is a schematic diagram of the cutting apparatus according to the preferred embodiment of the present invention.

As shown in FIG. 2, FIG. 3 and FIG. 4 of the drawings, when the cutting blade 20 is either in the first position or the second position, the actuation member 33 is arranged to operate between a locking position and an unlocking position, wherein in the locking position, the locking latch 332 is arranged to penetrate the first longitudinal portion 342 of the locking slot 34 so as to restrain the cutting blade 20 from rotating. At the same time, the locking latch 332 also penetrates the first securing member 321 and the second securing member 322. As a result, the locking strength is substantially reinforced because the first securing member 321 and the second securing member 322 assist in locking the cutting blade 20.

When the actuation member 33 is in the unlocking position, the actuation member 33 is upwardly pushed along its longitudinal direction so that the locking latch 332 is slid from the first longitudinal portion 342 to a correspond end of the curved portion 341 of the locking slot 34. When the locking latch has slid into the curved portion 341, the cutting blade 20 can be rotated about the pivot member 31 and is guided by the curved portion 341. In other word, when the cutting blade 20 is rotated from the first position to the second position or vice versa, the cutting blade 20 is not blocked by the locking latch 332 because the locking latch 332 is arranged to move along the curved portion 341 of the locking slot 34.

Thus, a width of the locking slot 34 is slightly larger than a diameter of the locking latch 332 so as to allow the locking latch 332 to slide along the locking slot 34 when the cutting blade 20 is rotating between the first position and the second position.

It is worth mentioning that the first longitudinal portion 342 and the second longitudinal portion 343 of the locking slot 34 are not curved (i.e. straightly extended). Thus, when the locking latch 332 is disposed in either the first longitudinal portion 342 or the second longitudinal portion 343 of the locking slot 34, the cutting blade 20 is prevented from rotating because a rotating motion of the cutting blade 20 is restricted by the first or the second longitudinal portion 342, 343 of the locking slot 34.

The actuation member 33 further comprises a resilient member 334 mounted to the first securing member 321 and the actuating panel 331 at a position near the driving member 333 for normally exerting a force to the actuating panel 331 for retaining the actuation member 33 at the locking position. Thus, when the cutting blade 20 is rotated such that the locking latch 332 aligns with the second longitudinal portion 343 of the locking slot 34, the locking latch 332 is pulled by the resilient member 334 to slide into the second longitudinal portion 343 of the locking slot 34 so as to lock the rotational movement of the cutting blade 20 again. At this point, the cutting blade 20 has moved from the first position to the second position.

In order to further enhance a rotational movement and the structural strength of the cutting apparatus, the blade rotation arrangement 30 further comprises a guiding member 35 and contains first through third guiding groove 361, 362, 363 formed on the cutting blade 20, the first securing member 321 and the second securing member 322 respectively, wherein the first through third guiding groove 361, 362, 363 are aligned with each other while the guiding member 35 is arranged to penetrate the cutting blade 20, the first securing member 321 and the second securing member 322 through the first through third guiding grooves 36. The second guiding groove 362 is formed at a mid blade portion 23 of the cutting blade 20.

It is important to mention that the guiding member 35 and the first through third guiding groove 361, 362, 363 are formed at positions spacedly apart from the locking slot 34 and are shaped and designed corresponding to the locking slot 34 so as to allow the guiding member 35 to slide along the first through third guiding groove 361, 362, 363 when the cutting blade 20 is rotating between the first position and the second position. From the above description, the rotational motion of the cutting blade 20 is substantially guided by the locking slot 34 and the three guiding grooves 361, 362, 363, and is stably supported by the first securing member 321 and the second securing member 322. Thus, the structural strength of the cutting apparatus of the present invention is substantially enhanced as compared with conventional cutting apparatuses.

The operation of the present invention is as follows: the actuating panel 331 is normally kept at the locking position of the actuation member 33 by the resilient member 334, and the cutting blade 20 is locked by the locking latch 332 penetrating the first longitudinal portion 342 of the locking slot 34. At this point, the cutting blade 20 is at the first position and the user may utilize the first blade portion 21 extended from the handle frame 10 for cutting, as shown in FIG. 1 of the drawings, and the first longitudinal portion 342 is positioned underneath the curved portion 341 of the locking slot 34 while the second longitudinal portion 343 is positioned above the curved portion 341.

When the user wishes to rotate the cutting blade 20, the user needs to push the driving member 333 of the actuation member 33 so as to slide the locking latch 332 from the first longitudinal portion 342 of the locking slot 34 into an adjacent end of the curved portion 341 of the locking slot 34. The normal pulling force exerted by the resilient element 334 is overcome by the pushing force exerted by the user. When the locking latch 332 is slid into the curved portion 341 of the locking slot 34, the user may manually rotate the cutting blade 20 and the locking latch 332 is arranged to slide along the curved portion from one end to the other while the cutting blade 20 is rotating. At the same time, the guiding member 35 also slides along the first through third guiding slot 361, 362, 363 for allowing the cutting blade 20 to rotate in a stable and smooth manner. After cutting blade 20 will keep on rotating and the locking latch 332 travels along the curved portion 341 of the locking slot 34 until the locking latch 332 aligns with the second longitudinal portion 343 of the locking slot 34. At this point, the cutting blade 20 is rotated such that the second longitudinal portion 343 is positioned underneath the curved portion 341 while the first longitudinal portion 342 is positioned above the curved portion 341. The user then needs to release his or her pushing force and the resilient element 334 exerts the normal pulling force to pull the locking latch 332 and the actuating panel 331 into the second longitudinal portion 343 of the locking slot 34. The cutting blade 20 is then locked at the second position. The user may unlock the cutting blade 20 again and allow the cutting blade 20 to rotate back to the first position following the same procedure described above.

When the user wishes to rotate the cutting blade 20 from the second position back to the first position, the user again needs to push the driving member 333 of the actuation member 33 so as to slide the locking latch 332 from the second longitudinal portion 343 of the locking slot 34 into an adjacent end of the curved portion 341 of the locking slot 34. The normal pulling force exerted by the resilient element 334 is overcome by the pushing force exerted by the user. When the locking latch 332 is slid into the curved portion 341 of the locking slot 34, the user may manually rotate the cutting blade 20 and the locking latch 332 is arranged to slide along the curved portion from one end to the other while the cutting blade 20 is rotating. At the same time, the guiding member 35 also slides along the first through third guiding slot 361, 362, 363 for allowing the cutting blade 20 to rotate in a stable and smooth manner. The cutting blade 20 will keep on rotating and the locking latch 332 travels along the curved portion 341 of the locking slot 34 until the locking latch 332 aligns with the first longitudinal portion 342 of the locking slot 34. At this point, the cutting blade 20 is rotated such that the first longitudinal portion 342 is positioned underneath the curved portion 341 again while the second longitudinal portion 343 is positioned above the curved portion 341. The user then needs to release his or her pushing force and the resilient element 334 exerts the normal pulling force to pull the locking latch 332 and the actuating panel 331 into the first longitudinal portion 342 of the locking slot 34. The cutting blade 20 is then locked at the first position again.

It is important to emphasize that the locking and unlocking mechanism of the present invention are accomplished by liner motion of the actuation member. This ensures stable and secure locking and unlocking of the cutting blade 20.

One skilled in the art will appreciate that the embodiment of the present invention as shown in the drawings and described above is illustrative only and not intended to be limiting. All embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cutting apparatus, comprising:

a handle frame which comprises a first elongated handle member and a second elongated handle member mounted to the first elongated handle member to form a receiving cavity between said first elongated handle member and said second elongated handle member;

a cutting blade having a first blade portion, a second blade portion, and a mid blade portion extended between said first blade portion and said second blade portion, wherein said cutting blade has a length longer than that of said handle frame; and a blade rotation arrangement, which comprises:

a pivot member extended from said handle frame to connect to said cutting blade for allowing said cutting blade to rotate about said pivot member between a first position and a second position, wherein in said first position, said cutting blade is rotated such that said first blade portion is extended out of said receiving cavity while said second blade portion is received in said receiving cavity, wherein in said second position, said cutting blade is rotated such that said second blade portion is extended out of said receiving cavity while said first blade portion is received in said receiving cavity;

a securing frame mounted in said receiving cavity of said handle frame and is positioned adjacent to said cutting blade for reinforcing said cutting blade when said cutting blade move between and at said first position and said second position; and an actuation member which is operatively mounted on said handle frame, and is arranged to selectively lock and retain said cutting blade in one of said first position and said second position, wherein said blade rotation arrangement further contains a locking slot provided on said mid blade portion of said cutting blade, wherein said actuation member is arranged to operatively engage with said locking slot for selectively locking and unlocking a rotational movement of said cutting blade, wherein said locking slot has a curved portion, and a first and a second longitudinal portions extended from two ends of said curved portion respectively along a longitudinal direction of said cutting blade, wherein each of said first securing member and said second securing member further has a restraining slot longitudinally formed thereon, wherein the restraining slots are aligned with said locking slot formed on said mid blade portion of said cutting blade.

2. The cutting apparatus, as recited in claim 1, wherein said actuation member comprises an actuating panel movably mounted in said receiving cavity of said handle frame, a locking latch transversely extended from a top end portion of said actuating panel, and a driving member transversely extended from lower end portion of said actuating panel to an exterior of said handle frame through said elongated actuation slot of said first elongated handle member, wherein said locking latch is extended from said actuating panel to slidably engage with said locking slot and said restraining slot of said first securing member and said second securing member, wherein when said cutting blade is in one of said first position and said second position, said actuation member is arranged to operate between a locking position and an unlocking position, wherein in said locking position, said locking latch is arranged to penetrate one of said first longitudinal portion and said second longitudinal portion of said locking slot so as to restrain said cutting blade from rotating while said locking latch also penetrates said first securing member and said second securing member, wherein in said unlocking position, said actuation member is upwardly pushed along a longitudinal direction thereof so that said locking latch is slid from said corresponding first longitudinal portion and said second longitudinal portion to a correspond end of said curved portion of said locking slot, wherein when said locking latch is slid into said curved portion, said cutting blade is capable of being rotated about said pivot member and is guided by said curved portion.

3. The cutting apparatus, as recited in claim 2, wherein said actuation member further comprises a resilient member mounted to said first securing member and said actuating panel for normally exerting a force to said actuating panel for retaining said actuation member at said locking position wherein when said cutting blade is rotated such that said locking latch aligns with one of said second longitudinal portion of said locking slot, said locking latch is pulled by said resilient member to slide into said corresponding first longitudinal portion and said second longitudinal portion of said locking slot so as to lock said rotational movement of said cutting blade.

4. The cutting apparatus, as recited in claim 3, wherein said blade rotation arrangement further comprises a guiding member and contains first through third guiding groove formed on said cutting blade, said first securing member and said second securing member respectively, wherein said first through third guiding groove are aligned with each other while said guiding member is arranged to penetrate said cutting blade, said first securing member and said second securing member through said first through third guiding grooves.

5. The cutting apparatus, as recited in claim 4, wherein said guiding member and said first through third guiding groove are formed at positions spacedly apart from said locking slot and are shaped and designed corresponding to said locking slot so as to allow said guiding member to slide along said first through third guiding groove when said cutting blade is rotating between said first position and said second position.

6. The cutting apparatus, as recited in claim 4, wherein said first elongated handle member further has an elongated actuation slot formed thereon for communicating with said receiving cavity, wherein said actuation member is partially exposed out of said receiving cavity for user's manual actuation through said actuation slot.

7. The cutting apparatus, as recited in claim 4, wherein said cutting blade further has a through slot formed on said mid blade portion, wherein said pivot member is arranged to penetrate said through slot to act as a pivot for supporting a rotational movement of said cutting blade about said pivot member.

8. A cutting apparatus, comprising:

a handle frame which comprises a first elongated handle member and a second elongated handle member mounted to the first elongated handle member to form a receiving cavity between said first elongated handle member and said second elongated handle member;

a cutting blade having a first blade portion, a second blade portion, and a mid blade portion extended between said first blade portion and said second blade portion, wherein said cutting blade has a length longer than that of said handle frame; and a blade rotation arrangement, which comprises:

a pivot member extended from said handle frame to connect to said cutting blade for allowing said cutting blade to rotate about said pivot member between a first position and a second position, wherein in said first position, said cutting blade is rotated such that said first blade portion is extended out of said receiving cavity while said second blade portion is received in said receiving cavity, wherein in said second position, said cutting blade is rotated such that said second blade portion is extended out of said receiving cavity while said first blade portion is received in said receiving cavity;

a securing frame mounted in said receiving cavity of said handle frame and is positioned adjacent to said cutting blade for reinforcing said cutting blade when said cutting blade move between and at said first position and said second position; and an actuation member which is operatively mounted on said handle frame, and is arranged to selectively lock and retain said cutting blade in one of said first position and said second position, wherein said securing frame comprises a first securing member and a second securing member mounted in said receiving cavity at two sides of cutting blade so as to sandwich said cutting blade between said first securing member and said second securing member, wherein each of said first securing member and said second securing member has a pivot hole formed thereon, wherein said pivot member is arranged to pass through said pivot holes of said first securing member and said second securing member and connect to said first elongated handle member and said second elongated handle member so that said cutting blade is also rotatably supported by said first securing member and said second securing member, wherein said blade rotation arrangement further contains a locking slot provided on said mid blade portion of said cutting blade, wherein said actuation member is arranged to operatively engage with said locking slot for selectively locking and unlocking a rotational movement of said cutting blade, wherein said locking slot has a curved portion, and a first and a second longitudinal portions extended from two ends of said curved portion respectively along a longitudinal direction of said cutting blade, wherein each of said first securing member and said second securing member further has a restraining slot longitudinally formed thereon, wherein the restraining slots are aligned with said locking slot formed on said mid blade portion of said cutting blade.

9. The cutting apparatus, as recited in claim 8, wherein said actuation member comprises an actuating panel movably mounted in said receiving cavity of said handle frame, a locking latch transversely extended from a top end portion of said actuating panel, and a driving member transversely extended from lower end portion of said actuating panel to an exterior of said handle frame through said elongated actuation slot of said first elongated handle member, wherein said locking latch is extended from said actuating panel to slidably engage with said locking slot and said restraining slot of said first securing member and said second securing member, wherein when said cutting blade is in one of said first position and said second position, said actuation member is arranged to operate between a locking position and an unlocking position, wherein in said locking position, said locking latch is arranged to penetrate one of said first longitudinal portion and said second longitudinal portion of said locking slot so as to restrain said cutting blade from rotating while said locking latch also penetrates said first securing member and said second securing member, wherein in said unlocking position, said actuation member is upwardly pushed along a longitudinal direction thereof so that said locking latch is slid from said corresponding first longitudinal portion and said second longitudinal portion to a correspond end of said curved portion of said locking slot, wherein when said locking latch is slid into said curved portion, said cutting blade is capable of being rotated about said pivot member and is guided by said curved portion.

10. The cutting apparatus, as recited in claim 9, wherein said actuation member further comprises a resilient member mounted to said first securing member and said actuating panel for normally exerting a force to said actuating panel for retaining said actuation member at said locking position wherein when said cutting blade is rotated such that said locking latch aligns with one of said second longitudinal portion of said locking slot, said locking latch is pulled by said resilient member to slide into said corresponding first longitudinal portion and said second longitudinal portion of said locking slot so as to lock said rotational movement of said cutting blade.

11. The cutting apparatus, as recited in claim 10, wherein said blade rotation arrangement further comprises a guiding member and contains first through third guiding groove formed on said cutting blade, said first securing member and said second securing member respectively, wherein said first through third guiding groove are aligned with each other while said guiding member is arranged to penetrate said cutting blade, said first securing member and said second securing member through said first through third guiding grooves.

12. The cutting apparatus, as recited in claim 11, wherein said guiding member and said first through third guiding groove are formed at positions spacedly apart from said locking slot and are shaped and designed corresponding to said locking slot so as to allow said guiding member to slide along said first through third guiding groove when said cutting blade is rotating between said first position and said second position.

13. The cutting apparatus, as recited in claim 12, wherein said first elongated handle member further has an elongated actuation slot formed thereon for communicating with said receiving cavity, wherein said actuation member is partially exposed out of said receiving cavity for user's manual actuation through said actuation slot.

14. The cutting apparatus, as recited in claim 13, wherein said cutting blade further has a through slot formed on said mid blade portion, wherein said pivot member is arranged to penetrate said through slot to act as a pivot for supporting a rotational movement of said cutting blade about said pivot member.

15. The cutting apparatus, as recited in claim 12, wherein said cutting blade further has a through slot formed on said mid blade portion, wherein said pivot member is arranged to penetrate said through slot to act as a pivot for supporting a rotational movement of said cutting blade about said pivot member.

16. The cutting apparatus, as recited in claim 8, wherein said blade rotation arrangement further comprises a guiding member and contains first through third guiding groove formed on said cutting blade, said first securing member and said second securing member respectively, wherein said first through third guiding groove are aligned with each other while said guiding member is arranged to penetrate said cutting blade, said first securing member and said second securing member through said first through third guiding grooves.

17. The cutting apparatus, as recited in claim 16, wherein said guiding member and said first through third guiding groove are formed at positions spacedly apart from said locking slot and are shaped and designed corresponding to said locking slot so as to allow said guiding member to slide along said first through third guiding groove when said cutting blade is rotating between said first position and said second position.

18. The cutting apparatus, as recited in claim 8, wherein said first elongated handle member further has an elongated actuation slot formed thereon for communicating with said receiving cavity, wherein said actuation member is partially exposed out of said receiving cavity for user's manual actuation through said actuation slot.

* * * * *